US006833029B2

(12) United States Patent
Borzone

(10) Patent No.: US 6,833,029 B2
(45) Date of Patent: Dec. 21, 2004

(54) SPRAY BOOTH WITH IMPROVED ELECTROSTATIC DISK

(75) Inventor: Achille Borzone, Cernusco Sul Naviglio (IT)

(73) Assignee: Transmetal S.p.A., Milan (IT)

( * ) Notice: Subject to any disclaimer, the term of this patent is extended or adjusted under 35 U.S.C. 154(b) by 0 days.

(21) Appl. No.: 10/477,403

(22) PCT Filed: Nov. 26, 2001

(86) PCT No.: PCT/EP01/14181

§ 371 (c)(1),
(2), (4) Date: Nov. 12, 2003

(87) PCT Pub. No.: WO02/43874

PCT Pub. Date: Jun. 6, 2002

(65) Prior Publication Data

US 2004/0149205 A1 Aug. 5, 2004

(30) Foreign Application Priority Data

Dec. 1, 2000 (IT) ..... MI2000A2606

(51) Int. Cl.[7] ..... B05C 19/04

(52) U.S. Cl. ..... 118/629; 118/308; 118/326; 239/707; 239/708

(58) Field of Search ..... 118/50.1, 620, 118/629, 308, 326; 239/690, 707, 708; 427/480, 483

(56) References Cited

U.S. PATENT DOCUMENTS 3,826,425 A * 7/1974 Scharfenberger et al. ... 239/700
4,216,000 A * 8/1980 Kofoid ..... 96/80

FOREIGN PATENT DOCUMENTS

| | | |
|---|---|---|
| EP | 0829306 | 3/1998 |
| GB | 2127370 | 4/1984 |

* cited by examiner

*Primary Examiner*—Laura Edwards
(74) *Attorney, Agent, or Firm*—Connolly Bove Lodge & Hutz LLP; Larry J. Hume

(57) ABSTRACT

A spray booth comprising an electrostatic disk (1) that is suitable to move along a shaft in order to position it at a chosen height with respect to a piece to be coated, the electrostatic disk (1) being provided with a plurality of electrodes (3) for generating an electrical field and for coating the piece to be coated by electrostatic disk is composed of a plurality of circulars sectors (1*a*), each powered by an independent voltage source (12).

5 Claims, 2 Drawing Sheets

SPRAY BOOTH WITH IMPROVED ELECTROSTATIC DISK

The present invention relates to a spray booth with improved electrostatic disk. It is known that spray booths are provided for coating for example metallic panels and allow to introduce the panel and pass it, by following an appropriate path, around at least one electrostatic disk provided to coat the panel.

Conventionally, the electrostatic disk can move along a vertical shaft whose axis is parallel to the vertical axis of the spray booth. The upward or downward translational motion of the electrostatic disk allows to coat the panel at all of its regions, also taking into account the fact that the panel follows a complex path around the electrostatic disk, so as to make both of its sides face the rim of said electrostatic disk.

The electrostatic disk is circumferentially provided with a plurality of electrodes that protrude radially from it and allow to generate an electrical field by virtue of which adhesion between the paint powder and the panel to be coated is produced.

FIG. 1 is a sectional view of an electrostatic disk, designated by the reference numeral 1, which can perform a translational motion along a shaft 2. The disk is provided with a plurality of electrodes 3 that protrude radially from it and is coupled to a base element 4 that is rigidly coupled to the shaft 2, forming between its lower surface and said base element 4 a chamber 5 that is directly connected to the outside environment by virtue of a channel 6 that is arranged adjacent to the shaft 2.

The paint powders by means of which the piece being processed is to be coated are introduced through the channel 6. The powder then passes through the chamber 5, and by virtue of the presence of pressurized air it is injected through a slit 7 that exits at the lower side of the electrodes 3.

The injection of air to push the paint powder through the slit 7 causes said powder to adhere to the surface of the panel to be coated by virtue of the presence of an electrical field generated by a voltage source connected to the upper surface of the electrostatic disk 1.

However, the above proposed solution has several constructive drawbacks. First of all, the presence of a high voltage of the electrodes, for example approximately 50 kV, triggers electrical discharges between the electrodes and the piece to be coated, since said panel, due to oscillations caused by its movement around the electrostatic disk 1, sometimes tends to move excessively close to said electrostatic disk.

The oscillations caused by the movement of the panel therefore reduce considerably the coating distance, consequently triggering electrical discharges between the electrodes and the panel.

Currently, safety is ensured by a threshold system that limits the maximum value of the current that can flow through the electrode, thus reducing the possibility of triggering the discharges.

Every time the current exceeds the preset maximum threshold value, the control system stops the unit.

However, since oscillations of the panels are quite frequent, and since the reduction of the useful distance between the panel and the electrodes entails the triggering of electrical discharges, there are many unit stoppages when the above described threshold system is used.

Another known type of control system uses a feedback control that allows to keep the power level constant, reducing the voltage as the current increases. However, said control system is not rapid enough to avoid the electrical discharge once it has been triggered.

Currently, the statutory provisions that govern the safety of spray booths entail, for the power levels involved, the adoption of a fire-fighting system. This naturally complicates considerably the construction of the spray booth in addition to increasing its costs.

Furthermore, the electrodes that generate the electrical field for the electrostatic deposition of paint powders on the panel to be coated lose their efficiency over time, since there is a strong adhesion of powder to the surface of the electrode, reducing its efficiency.

For this purpose, in order to improve penetration in cavities or recesses of the piece to be coated, powders with a smaller than normal particle size are used, accordingly requiring custom production. This entails a cost problem that increases as the size of the batch to be coated decreases and therefore the required amount of powders decreases.

The aim of the present invention is to provide a spray booth with improved electrostatic disk, which allows to reduce considerably the possibility of triggering electrical discharges between the electrodes and the surfaces of the pieces to be coated.

Within the scope of this aim, an object of the present invention is to provide a spray booth with improved electrostatic disk that allows to reduce drastically system stoppages caused by the triggering of discharges between the electrodes and the surfaces of the pieces to be coated.

Another object of the present invention is to provide a spray booth with improved electrostatic disk that does not require fire-fighting systems because the power levels generated are contained within preset limits set by currently applicable statutory provisions.

Another object of the present invention is to provide a spray booth with improved electrostatic disk that does not require the use of coating powders having a particular particle size in order to achieve satisfactory penetration in the cavities of the piece to be coated.

Another object of the present invention is to provide a spray booth with improved electrostatic disk that is highly reliable, relatively simple to provide, and at competitive costs.

This aim, these objects and others that will become apparent hereinafter are achieved by a spray booth comprising an electrostatic disk that is suitable to move along a shaft in order to position it at a chosen height with respect to a piece to be coated, said electrostatic disk being provided with a plurality of electrodes for generating an electrical field and coating said piece to be coated by electrostatic adhesion, characterized in that said electrostatic disk comprises a plurality of circular sectors, each powered by an independent voltage source. Further characteristics and advantages of the invention will become apparent from the description of a preferred but not exclusive embodiment of the spray booth according to the invention, illustrated as regards the electrostatic disk in the accompanying drawings, wherein:

Figure 1:
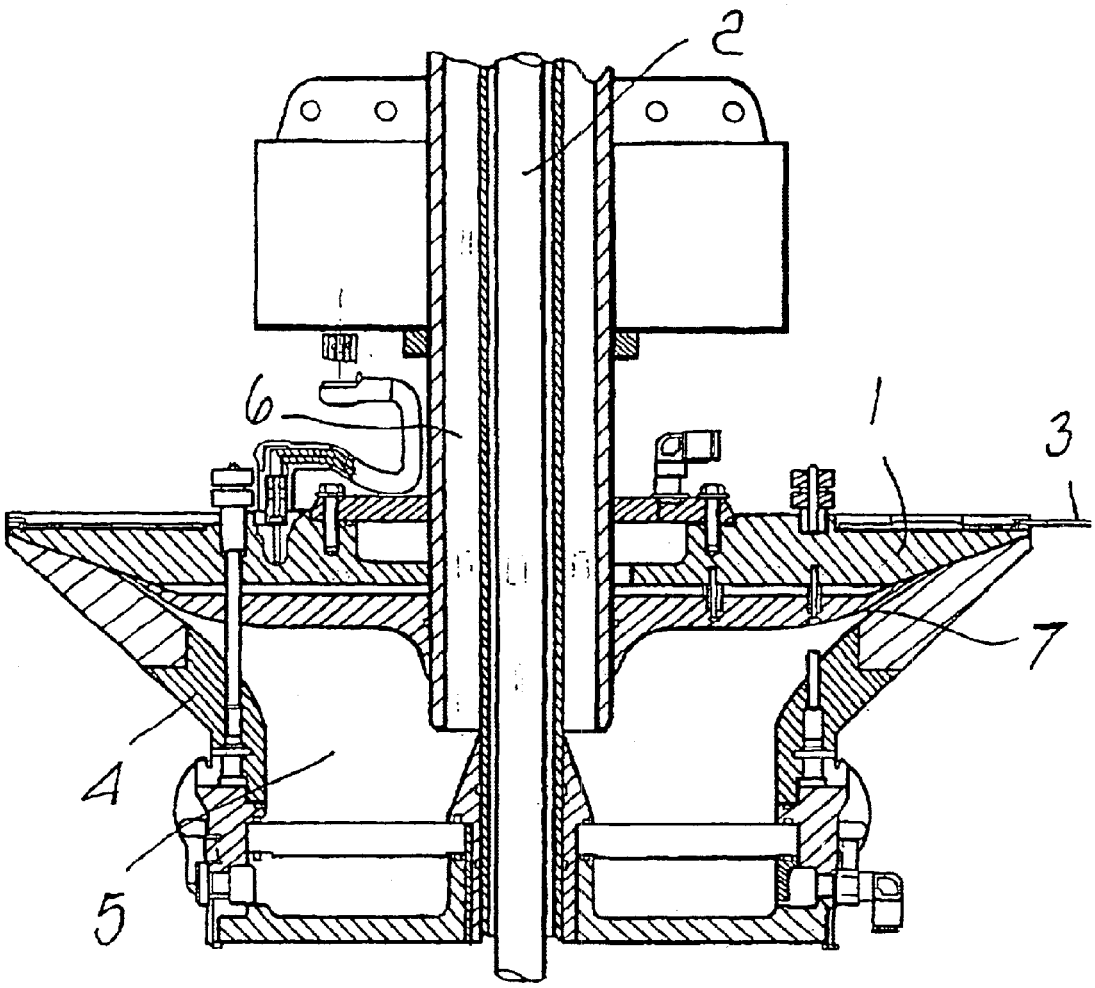
FIG. 1 is a sectional view, illustrating a known type of electrostatic disk.
Figure 4:
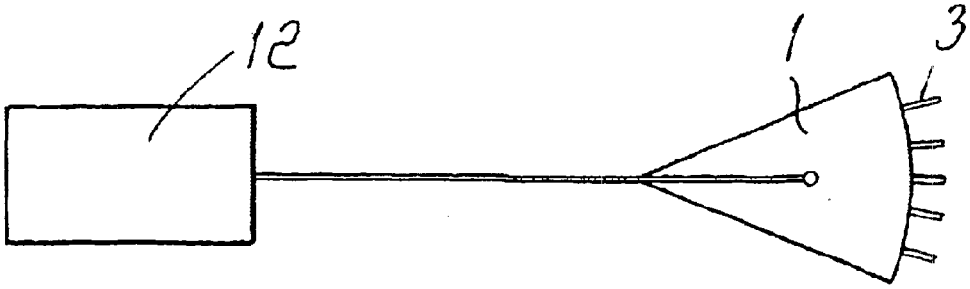
FIG. 4 is a schematic view of the connection of a voltage source for each portion of the electrostatic disk.

With reference to the above cited figures, in which identical reference numerals designate identical elements, the electrostatic disk, again designated by the reference numeral 1, as shown in FIG. 1, is coupled to a base element 4 that is rigidly coupled to the shaft 2 along which the disk itself moves; a chamber 5, through which the painting powder passes, is formed between the lower surface of the disk 1 and the base element 4.

Figure 2:
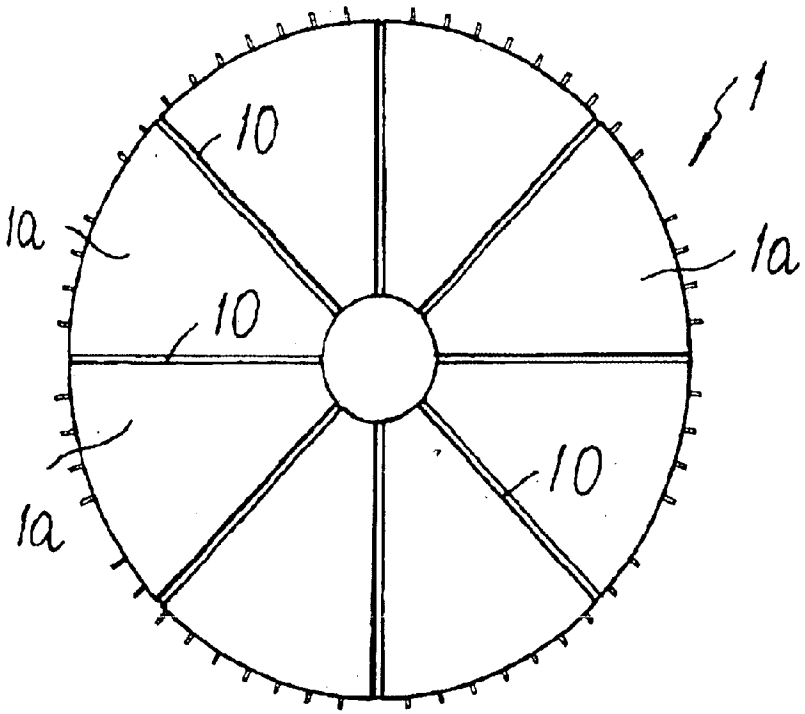
FIG. 2 is a plan view of the electrostatic disk suitable to be used in the spray booth according to the present invention.

As illustrated in FIG. 2, which is a plan view of the electrostatic disk according to the present invention, the disk 1 has the particularity of being divided into a plurality of circular sectors 1*a* . . . 1*n*, in which each sector is separated from an adjacent sector by means of at least one insulating partition 10; further, each one of said circular sectors is advantageously powered by a respective voltage source 12, so as to maintain at a low level the power generated at the electrodes of each circular sector; said voltage sources 12 allows to generate a potential difference between the electrodes 3 that protrude radially from the circular sector 1*a* . . . 1*n* and the surface of the panel to be coated, not shown in the figures, which is connected to the ground potential. In this manner, coating by electrostatic adhesion of the paint powder to the surface of the panel to be coated is achieved.

Figure 3:
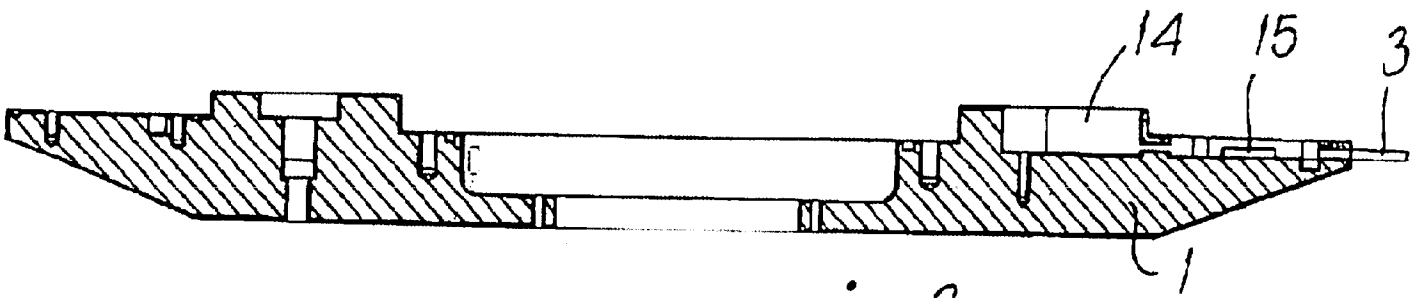
FIG. 3 is a sectional view of the electrostatic disk of FIG. 2.

Conveniently, as shown in FIG. 3, the electrostatic disk 1, and particularly each sector 1*a* . . . 1*n* that composes the electrostatic disk 1, is furthermore provided with a chamber 14 for injecting air for cleaning the electrodes 3. Said chamber allows to introduce air, for example under pressure, in order to clean the electrodes 3 of the powder that inevitably remains attached to them during the coating process.

The air injection chamber furthermore allows to eliminate the need to use paint powders having a very small particle size, thus reducing the costs of said powder.

It has been found that the number of circular sectors 1*a* . . . 1*n* into which the electrostatic disk 1 can be divided is variable at will, but preferably each circular sector should subtend an angle of 60 or 30°, so as to divide the disk 1 into six or twelve circular sectors.

It is of course possible to divide the electrostatic disk 1 into a different number of circular sectors.

Between the chamber 14 for injecting air for cleaning the electrodes 3 and the electrodes 3 themselves, along the path connecting the chamber and the electrodes, there is at least one protective resistor 15.

In practice it has been found that the spray booth with the electrostatic disk according to the present invention fully achieves the intended aim and objects, since it allows to reduce substantially the electrical discharges that can be triggered between the electrodes and the surface of the panel to be coated, by virtue of the reduction of the maximum current, and therefore of the maximum power, generated at the electrodes of each circular sector. In this manner it is not necessary to provide fire-fighting systems inside the spray booth, with a consequent cost reduction.

Furthermore, the reduction of the possibility of triggering electrical discharges between the electrodes and the panel to be coated allows to avoid as much as possible stoppages of the coating unit.

Furthermore, the presence of a chamber for injecting air for cleaning the electrodes, arranged at the upper surface of the electrostatic disk, proximate to the electrodes, allows to use paint powders having a conventional particle size, without therefore requiring custom-made products in order to penetrate in the cavities of the panel to be coated.

The spray booth with the electrostatic disk thus conceived is susceptible of numerous modifications and variations, all of which are within the scope of the inventive concept; all the details may furthermore be replaced with other technically equivalent elements.

In practice, the materials used, so long as they are compatible with the specific use, as well as the dimensions and shapes, may be any according to the requirements and the state of the art.

What is claimed is:

1. A spray booth comprising an electrostatic disk (1) that is suitable to move along a shaft (2) in order to position it at a chosen height with respect to a piece to be coated, said electrostatic disk (1) being provided with a plurality of electrodes (3) for generating an electrical field and coating said piece to be coated by electrostatic adhesion, characterized in that said electrostatic disk (1) comprises a plurality of circular sectors (1*a*), each powered by an independent voltage source (12).

2. The spray booth according to claim 1, characterized in that the sectors (1*a*) of said electrostatic disk (1) are mutually separated by partitions (10) made of insulating material.

3. The spray booth according to claim 1, characterized in that each one of said circular sectors (1*a*) has, proximate to its upper surface, adjacent to the corresponding electrodes (3), a chamber (14) for injecting air suitable to clean the surface of said electrodes (3).

4. The spray booth according to claim 3, characterized in that it comprises a protective resistor (15) arranged along the path that connects said air injection chamber (14) to said electrodes (3).

5. The spray booth according to any one of the preceding claims, characterized in that said electrostatic disk (1) is rigidly coupled to a supporting element (4) suitable to form, with the lower surface of said disk (1), a chamber (5) for the passage of paint powder.

* * * * *

UNITED STATES PATENT AND TRADEMARK OFFICE

CERTIFICATE OF CORRECTION

PATENT NO. : 6,833,029 B2
DATED : December 21, 2004
INVENTOR(S) : Achille Borzone It is certified that error appears in the above-identified patent and that said Letters Patent is hereby corrected as shown below:

Title page,
Item [73], Assignee, "Transmetal S.p.A., Milan (IT)" should read
-- Trasmetal S.p.A., Milan (IT) --.

Signed and Sealed this

Sixteenth Day of August, 2005

JON W. DUDAS
*Director of the United States Patent and Trademark Office*